US012799953B2

(12) United States Patent
Sel Franco

(10) Patent No.: US 12,799,953 B2
(45) Date of Patent: Nov. 17, 2026

(54) MULTI-EJECTOR VACUUM GENERATOR, FASTENING MEANS MULTI-EJECTOR VACUUM GENERATOR AND VACUUM GENERATOR PUMP

(71) Applicant: Luiz Tadeu Sel Franco, São Paulo (BR)

(72) Inventor: Luiz Tadeu Sel Franco, São Paulo (BR)

( * ) Notice: Subject to any disclaimer, the term of this patent is extended or adjusted under 35 U.S.C. 154(b) by 187 days.

(21) Appl. No.: 18/535,679

(22) Filed: Dec. 11, 2023

(65) Prior Publication Data

US 2024/0200578 A1 Jun. 20, 2024

(30) Foreign Application Priority Data

Dec. 20, 2022 (BR) ..... 102022026102-4

(51) Int. Cl.
*F04F 5/22* (2006.01)
*F04F 5/46* (2006.01)

(52) U.S. Cl.
CPC ..... *F04F 5/22* (2013.01); *F04F 5/466* (2013.01)

(58) Field of Classification Search
None
See application file for complete search history.

(56) References Cited

U.S. PATENT DOCUMENTS 2,378,425 A * 6/1945 Lamont ..... F04F 5/467 417/174
3,959,864 A * 6/1976 Tell ..... F04F 5/22 417/174
4,395,202 A * 7/1983 Tell ..... F04F 5/22 417/174
4,466,778 A * 8/1984 Volkmann ..... F04F 5/44 417/174
4,609,328 A * 9/1986 Cirrito ..... F04F 5/467 417/89
4,696,625 A * 9/1987 Greenberg ..... F04F 5/22 417/174
4,790,054 A * 12/1988 Nichols ..... B23P 13/02 29/890.142

(Continued)

FOREIGN PATENT DOCUMENTS

GB 2207952 A * 2/1989 ..... F04F 5/461

*Primary Examiner* — Dominick L Plakkoottam
*Assistant Examiner* — Geoffrey S Lee
(74) *Attorney, Agent, or Firm* — Studebaker Brackett PLLC

(57) ABSTRACT

The present disclosure relates to a multi-ejector vacuum generator for vacuum generating pump having three stages and four nozzles. Each stage includes a vacuum chamber and diaphragms. The distal end of the first nozzle is connected to the vacuum chamber of the first stage; the proximal end of the second nozzle is connected to the first stage vacuum chamber; the distal end of the second nozzle is connected to the second stage vacuum chamber; the proximal end of the third nozzle is connected to the second stage vacuum chamber; the distal end of the third nozzle is connected to the third stage vacuum chamber; and the proximal end of the fourth nozzle is connected to the third stage vacuum chamber. The present disclosure relates to a vacuum generator pump having a multi-ejector vacuum generator and a multi-ejector vacuum generator fastening means.

10 Claims, 9 Drawing Sheets

(56) References Cited

U.S. PATENT DOCUMENTS

| | | | | |
|---|---|---|---|---|
| 4,880,358 | A * | 11/1989 | Lasto | F04F 5/22 417/174 |
| 5,205,717 | A * | 4/1993 | Tell | F04F 5/22 417/189 |
| 6,171,068 | B1 * | 1/2001 | Greenberg | F04F 5/22 417/174 |
| 6,394,760 | B1 * | 5/2002 | Tell | F04F 5/467 417/174 |
| 8,231,358 | B2 * | 7/2012 | Cho | F04F 5/22 417/189 |
| 10,400,796 | B2 * | 9/2019 | Cho | F04F 5/44 |
| 10,767,662 | B2 | 9/2020 | Tell | |
| 11,149,752 | B2 * | 10/2021 | Cho | F04F 5/20 |
| 2005/0077373 | A1 * | 4/2005 | Ikeda | B60T 13/52 239/34 |
| 2007/0148009 | A1 * | 6/2007 | Cho | F04F 5/467 417/174 |
| 2009/0155668 | A1 * | 6/2009 | Ban | H01M 8/04097 429/411 |
| 2015/0300377 | A1 * | 10/2015 | Tell | F04F 5/467 417/190 |
| 2015/0316074 | A1 * | 11/2015 | Tell | F04F 5/16 417/54 |
| 2017/0152868 | A1 * | 6/2017 | Onishi | F04F 5/26 |
| 2023/0304510 | A1 * | 9/2023 | Yorns | F04F 5/467 |

* cited by examiner

MULTI-EJECTOR VACUUM GENERATOR, FASTENING MEANS MULTI-EJECTOR VACUUM GENERATOR AND VACUUM GENERATOR PUMP

CROSS-REFERENCE TO RELATED APPLICATIONS

This application claims the priority of Brazilian Patent Application No. 102022026102-4 filed on Dec. 20, 2022, in the Brazil Intellectual Property Office, the disclosure of which is incorporated herein by reference.

FIELD OF INVENTION

The present invention belongs to the field of industrial vacuum pumps, more specifically to vacuum pumps that use ejectors. The main application of this vacuum pump is cargo transportation.

PRIOR ART

Vacuum pumps with ejectors or multi-ejectors use compressed air, inert gases or steam which, when subjected to convergent-divergent tubes, result in a drop in pressure.

Multi-ejector vacuum pumps use the Venturi principle to generate a vacuum. Each nozzle comprises a convergent-divergent nozzle, in order to accelerate the fluid, decreasing its pressure, producing the vacuum for industrial applications.

The closest prior art documents are U.S. Pat. No. 10,400,796B2 and U.S. Pat. No. 10,767,662B2.

U.S. Pat. No. 10,400,796B2 fails to describe nozzles. U.S. Pat. No. 10,400,796B2 reveals that any nozzle can be used as long as it has an inlet, an outlet and a connection to the outside air along its length. This prior art also presents a fixation means completely different from that proposed by the present invention.

U.S. Pat. No. 10,767,662B2 on the other hand reveals nozzles with circular, square or other non-circular cross-sections.

The lack of concern with the geometry of the nozzles, as well as their dimensions, results in an efficiency considerably lower than that presented by the present invention.

Objective of the Present Invention

The present invention aims to present a considerably higher efficiency than the vacuum pumps on the market, in particular, the multi-ejector vacuum pumps.

BRIEF DESCRIPTION OF THE INVENTION

The present invention discloses a multi-ejector vacuum generator for a vacuum generating pump comprising at least three stages and at least four nozzles, each stage comprising a vacuum chamber and at least two diaphragms configured to act as one-way valves; each nozzle is configured to act as a receiver at its proximal end and an ejector at its distal end; wherein, the first nozzle is convergent-parallel-divergent, the second nozzle is parallel, the third nozzle is parallel-divergent and the fourth nozzle is parallel-divergent; wherein, the distal end of the first nozzle is connected to the first stage vacuum chamber in its proximal portion; the proximal end of the second nozzle is connected to the first stage vacuum chamber in its distal portion; the distal end of the second nozzle is connected to the second stage vacuum chamber in its proximal portion; the proximal end of the third nozzle is connected to the second stage vacuum chamber in its distal portion; the distal end of the third nozzle is connected to the third stage vacuum chamber in its proximal portion; and the proximal end of the fourth nozzle is connected to the third stage vacuum chamber in its distal portion.

The present multi-ejector vacuum generator for vacuum generator pumps reveals that the nozzles are positioned internally to the stages, configured longitudinally, and the diaphragms are positioned on the external surfaces of the stages vacuum chamber, orthogonally to the nozzles.

Said multi-ejector vacuum generator for vacuum generator pumps provides a feeding sleeve configured to connect the compressed air inlet with the first nozzle.

The present multi-ejector vacuum generator for vacuum generator pump establishes that between the compressed air inlet and the first nozzle there is a manifold reservoir or air passage control solenoid valves.

The multi-ejector vacuum generator for vacuum generator pump disclosed by the present invention establishes that the first nozzle has in its parallel portion, a diameter preferably between 3 and 60 mm, more preferably between 4 and 56 mm, even more preferably between 4.24 mm and 54.38 mm, and in its divergent portion, angle of divergence preferably between 7 and 9 degrees, more preferably between 7.5 and 8.5 degrees, even more preferably between 7.9 and 8.3 degrees, and maximum diameter preferably between 5 and 95 mm, more preferably between 6 and 90 mm, even more preferably between 6.93 and 88.82 mm.

The present multi-ejector vacuum generator for vacuum generator pump discloses that the second nozzle has an internal diameter preferably between 10 and 160 mm, more preferably between 11 and 155 mm, even more preferably between 11.73 and 150.45 mm.

Said multi-ejector vacuum generator for vacuum generating pump establishes that the third nozzle has in its parallel portion, a diameter preferably between 15 and 210 mm, more preferably between 15.5 and 205 mm, even more preferably between 15.83 and 203.01 mm and in its divergent portion, maximum diameter preferably between 17 and 240 mm, more preferably between 18 and 236 mm, even more preferably between 18.32 and 234.91 mm and angle of divergence preferably between 0.5 and 3.5 degrees, more preferably between 1 and 3 degrees, even more preferably between 1.5 and 2.5 degrees.

The present multi-ejector vacuum generator for vacuum generating pump discloses that the fourth nozzle has in its parallel portion, a diameter preferably between 22 and 295 mm, more preferably between 22.5 and 293 mm, even more preferably between 22.81 and 292.54 mm and in its divergent portion, maximum diameter preferably between 25 and 330 mm, more preferably between 25.50 and 327.06 mm, and angle of divergence preferably between 1 and 5 degrees, even more preferably between 1.5 and 3 degrees.

The multi-ejector vacuum generator for vacuum generator pump disclosed by the present invention determines that the distance between the distal surface of the first nozzle and the proximal surface of the second nozzle is preferably between 2 and 40 mm, more preferably 2.5 and 38.5 mm, even more preferably between 2.93 and 37.61 mm, the distance between the distal surface of the second nozzle and the proximal surface of the third nozzle is preferably between 2 and 55 mm, more preferably 3 and 53 mm, even more preferably between 3.96 and 50.75 mm and the distance between the distal surface of the third nozzle and the proximal surface of the fourth nozzle is preferably between 4 and 80 mm, more preferably 5 and 75 mm, even more preferably between 5.70 and 73.14 mm.

The present multi-ejector vacuum generator for vacuum generator pump establishes that the diaphragms are configured to allow air to enter the vacuum chambers when the outside pressure is greater than the inside pressure.

Said multi-ejector vacuum generator for vacuum generator pump determines that stages and nozzles are connected by thread, snap rings, under pressure or interference.

The present multi-ejector vacuum generator for vacuum generating pump establishes that the dimensioning of the components of said multi-ejector vacuum generator comprises the following steps:

a. definition of the free vacuum flow to the atmosphere intended to obtain the required flow;
b. definition of the consumption of the vacuum generator pump;
c. calculation of the diameter of the first nozzle based on the consumption defined in the previous step;
d. definition of the expected vacuum level in the multi-ejector vacuum generator;
e. definition of a supersonic speed in the first nozzle;
f. calculation of the maximum diameter of the first nozzle in order to provide the reduction in pressure without its total conversion into kinetic energy;
g. calculation of the receiver diameter based on the vacuum level defined in the first chamber;
h. calculation of the minimum distance between the first and second nozzles;
i. calculation of the diameter of the second nozzle based on the consumption defined in a previous step;
j. definition of the expected vacuum level in the multi-ejector vacuum generator;
k. definition of a supersonic speed in the second nozzle;
l. calculation of the maximum diameter of the second nozzle in order to provide the reduction in pressure without its total conversion into kinetic energy;
m. calculation of the receiver diameter based on the vacuum level defined in the second chamber;
n. calculation of the minimum distance between the second and third nozzles;
o. calculation of the diameter of the third nozzle based on the consumption defined in a previous step;
p. definition of the expected vacuum level in the multi-ejector vacuum generator;
q. definition of a supersonic speed in the third nozzle;
r. calculation of the maximum diameter of the third nozzle in order to provide the pressure reduction without its total conversion into kinetic energy;
s. calculation of the receiver diameter based on the vacuum level defined in the third chamber;
t. calculation of the minimum distance between the third and fourth nozzles;
u. calculation of the diameter of the fourth nozzle based on the consumption defined in a previous step;
v. definition of the expected vacuum level in the multi-ejector vacuum generator;
w. definition of a supersonic speed in the fourth nozzle;
x. calculation of the maximum diameter of the fourth nozzle in order to provide the decrease in pressure without its total conversion into kinetic energy;
y. calculation of the receiver diameter based on the vacuum level defined in the application.

The present invention also discloses fastening means for multi-ejector vacuum generators for a vacuum generator pump, comprising quick-release fastening system having different openings configured so that when the pressure feeding inlet, provided with quick-release fastening pins, exceed the quick-release fastening system and are rotated to the defined position on the second quick-release fastening system, the quick-release fastening system does not allow its rotational movement, and the quick-release fastening system does not allow translational movement in the direction in which it entered.

The present invention also discloses a vacuum generator pump comprising a multi-ejector vacuum generator as defined by the present invention.

The vacuum generator pump disclosed by the present invention comprises multi-ejector vacuum generator fastening means as defined by the present invention.

Figure 1:
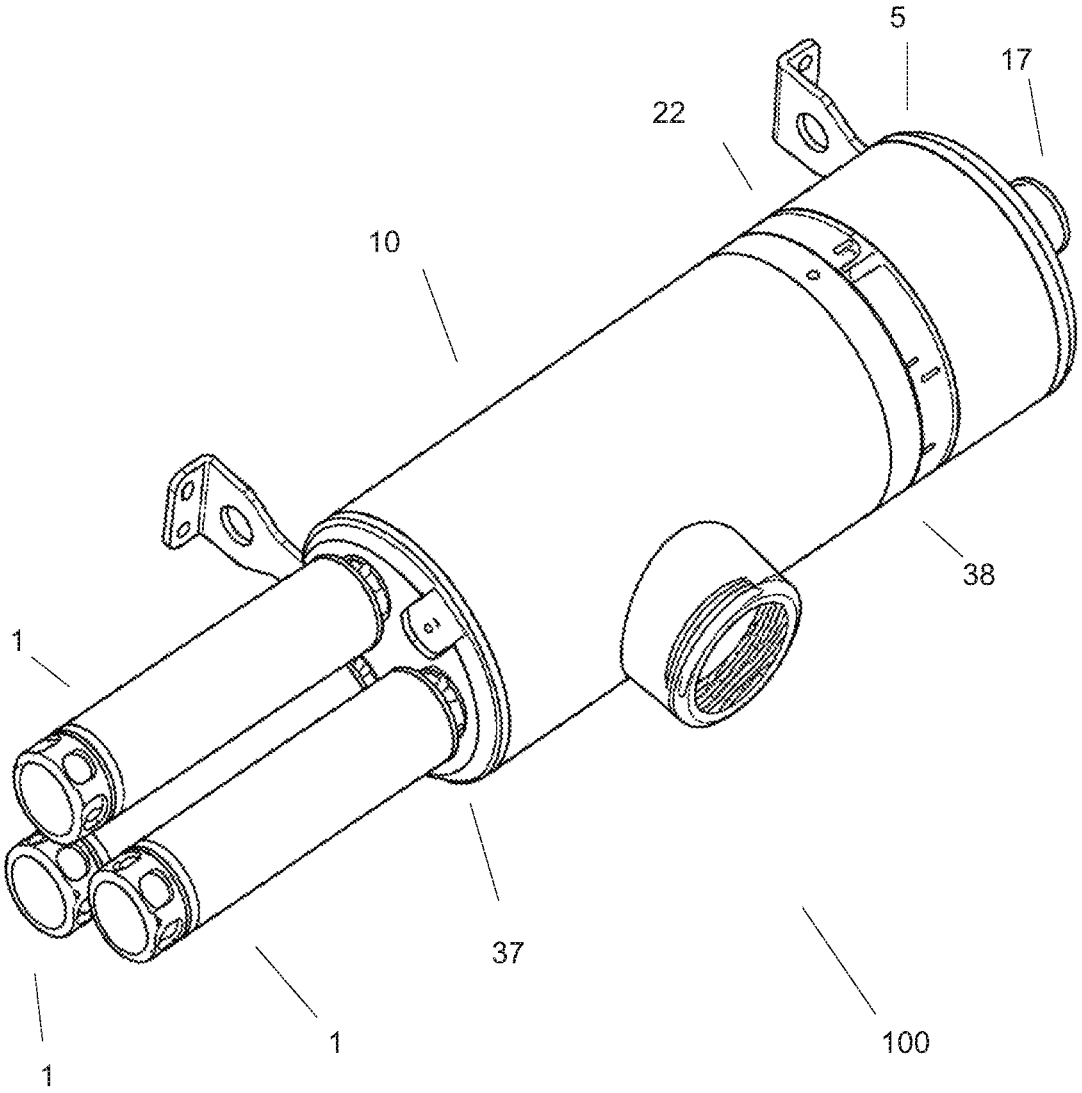
FIG. 1 shows an embodiment of the present invention in perspective.
Figure 2:
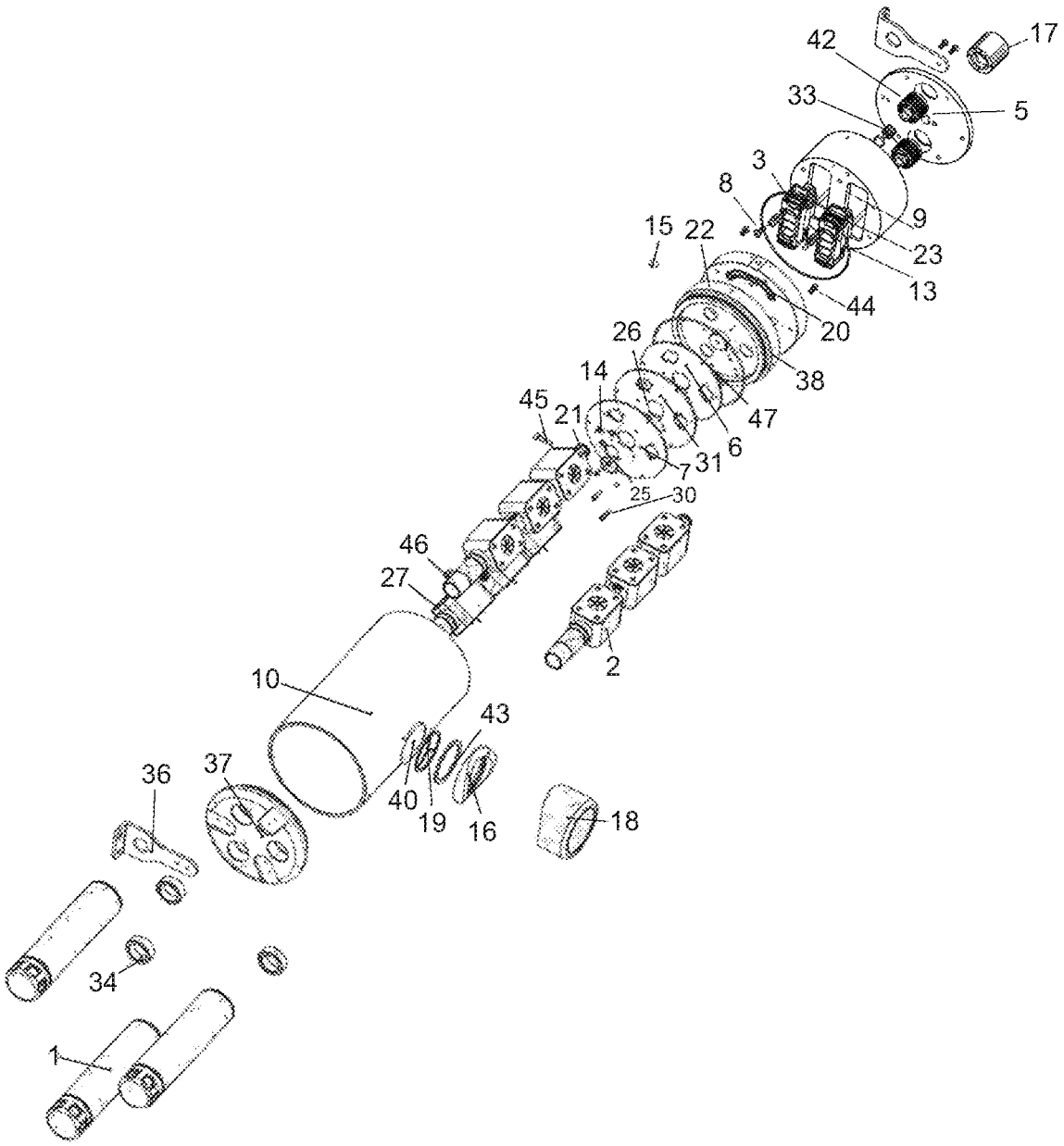
FIG. 2 shows an exploded view of one embodiment of the present invention.
Figure 3:
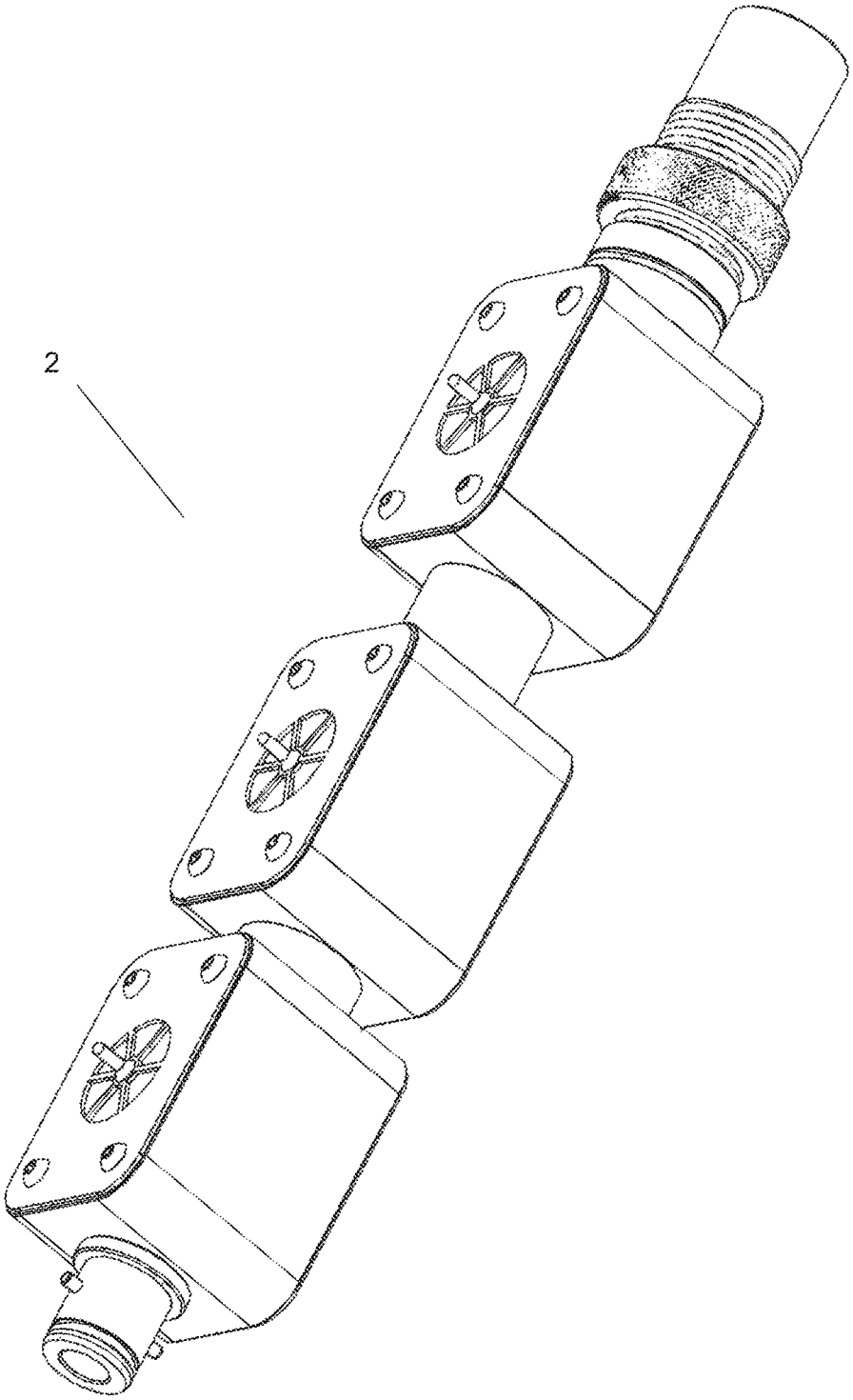
FIG. 3 shows a configuration of multi-ejector vacuum generators comprising convergent-divergent ejectors or nozzles of the present invention.
Figure 4:
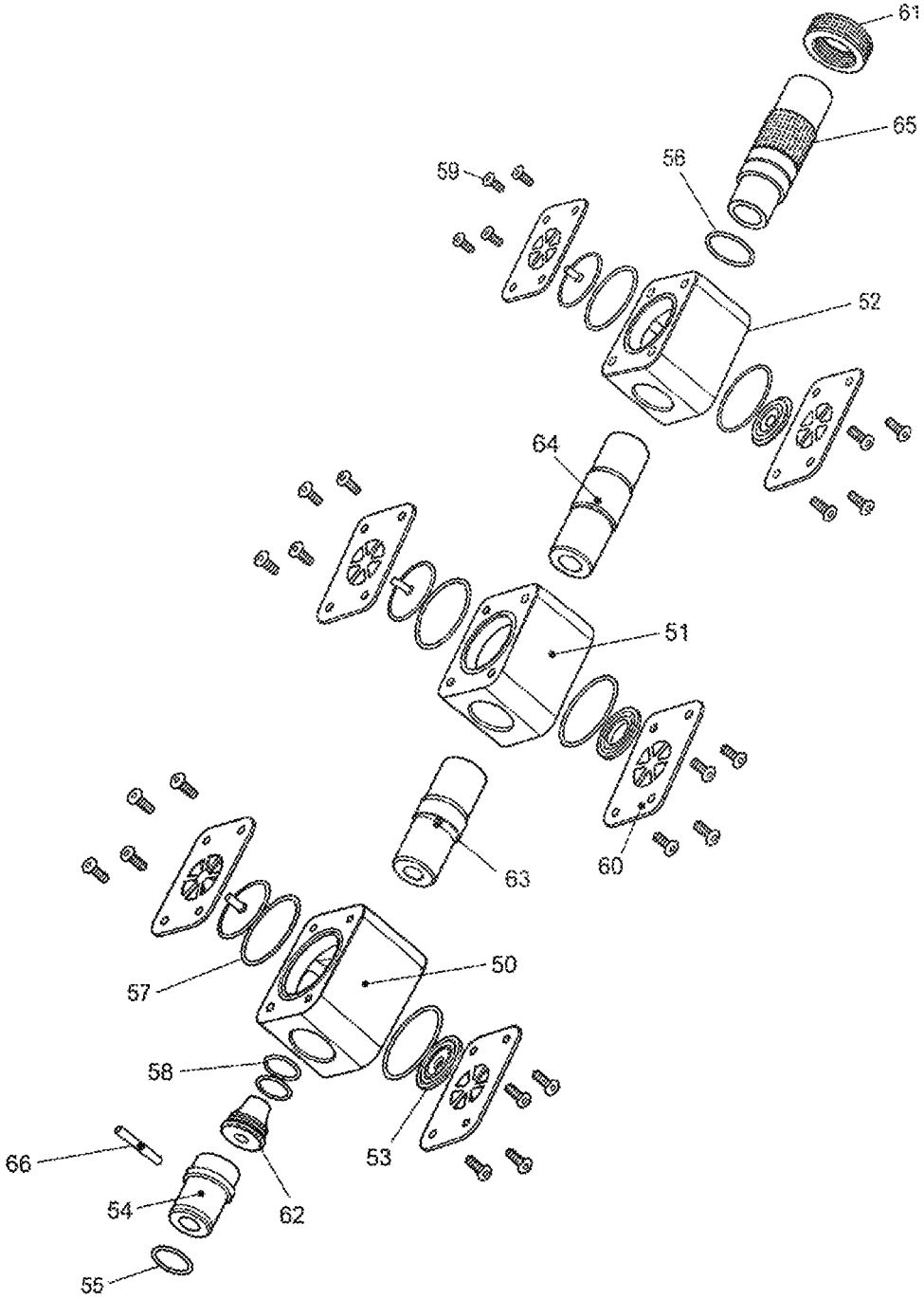
FIG. 4 shows an exploded view of one configuration of the multi-ejector vacuum generators of the present invention.
Figures 5A, 5B:
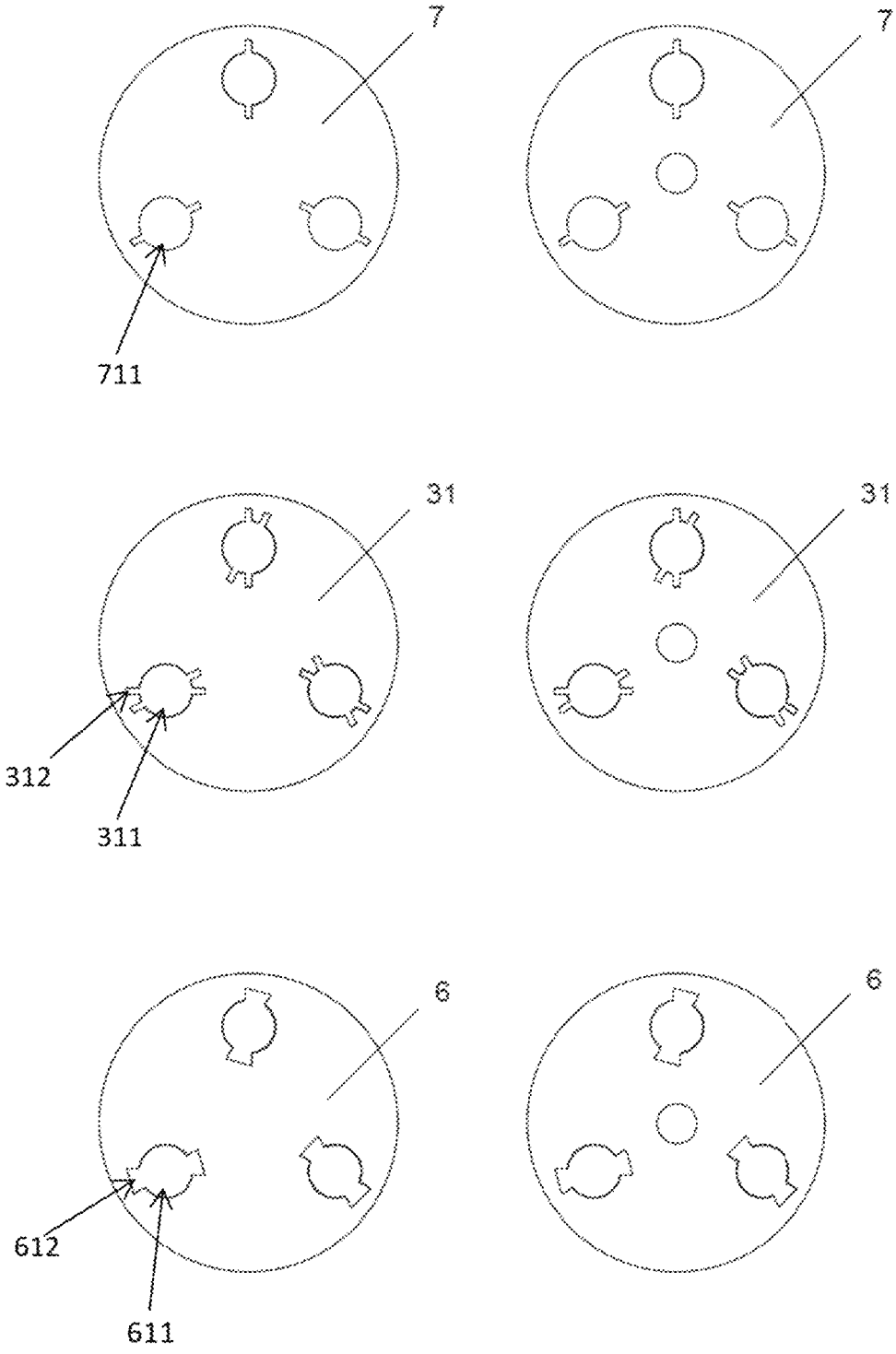
FIGS. 5A and 5B show different configurations of the fastening means of the multi-ejector vacuum generators.
Figure 6:
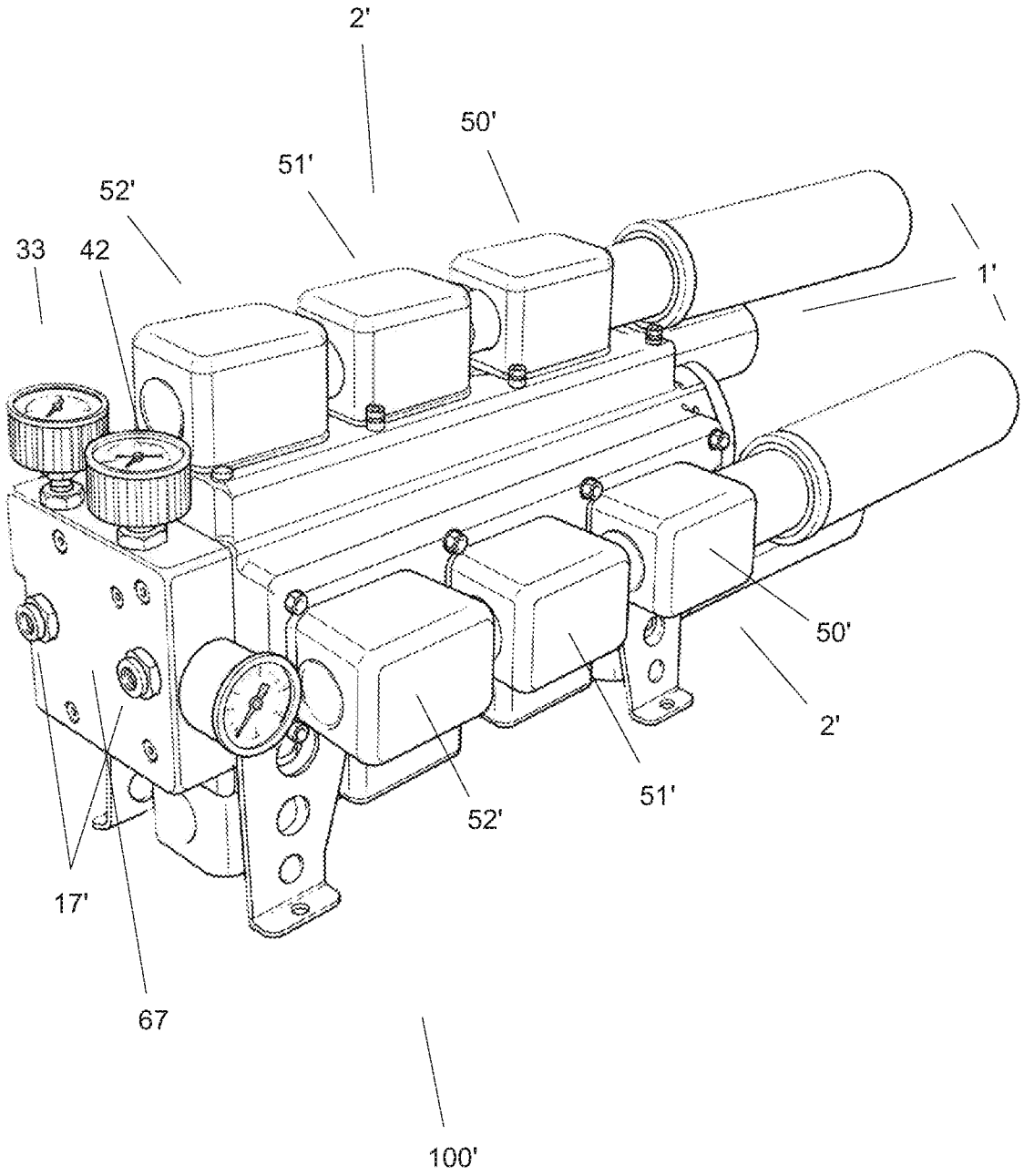
FIG. 6 shows a rear perspective view of one embodiment of the present invention.
Figure 7:
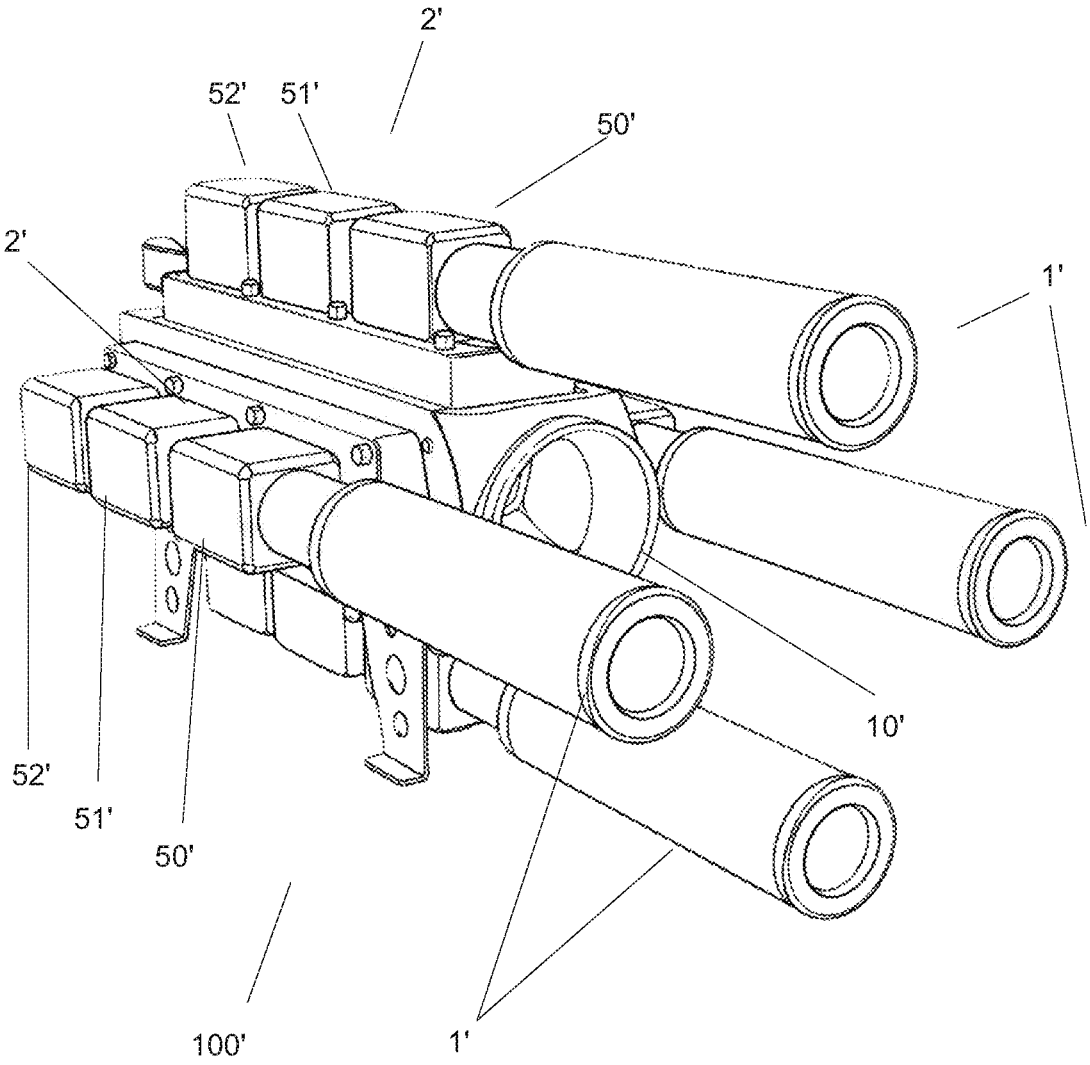
FIG. 7 shows a front perspective view of one embodiment of the present invention.

The reference numbers used in this application are: 1—Suppressor; 2—Multi-ejector vacuum generator; 3—Female electrical connection of the pneumatic solenoid valve, mounted on the body; 5—Top closing lid; 6—Quick-release fastening system; 7—Quick-release fastening system; 9—Finishing cap for the solenoid valves; 10—Vacuum pump body; 13—Air passage control solenoid valves; 14—Quick-release fastening system; 16—Internal support for fastening the vacuum inlet flange; 17—Compressed air inlet flange; 18—Vacuum inlet flange; 19—Reinforcement ring for the mesh; 20—Function plate for compressed air; 21—Quick-release fastening pin; 22—Vacuum pump body closing O-ring; 23—Sealing O-ring; 25—Quick-release fastening system; 26—Quick-release fastening system; 25—Upper sealing O-ring; 27—Lower sealing O-ring; 31—Quick-release fastening system; 33—Pressure gauge; 34—Ejector fastening nut; 36—Fastening support; 37—Lower closing lid; 38—Compressed air passage plate; 40—Steel mesh at the vacuum inlet; 42—Vacuum gauge; 43—O-ring; 46—In series set of tubes of the multi-ejector; 47—Quick-release fastening system; 50—First stage; 51—Second stage; 52—Third stage; 53—Diaphragm; 54—Feeding sleeve; 55—O-ring; 56—O-ring; 57—O-ring; 58—O-ring; 59—Screw; 60—Plate; 61—Nut; 62—First nozzle; 63—Second nozzle; 64—Third nozzle; 65—Fourth nozzle; 66—Locking pin; 67—Manifold; 100—Vacuum generating pump. Reference numerals with ' represent constructive variations of the present invention.

DETAILED DESCRIPTION OF THE INVENTION

The present invention discloses a multi-ejector vacuum generator for vacuum generating pump comprising at least three stages 50, 51, 52, and at least four nozzles 62, 63, 64, 65, each stage 50, 51, 52 comprises a vacuum chamber and at least two diaphragms 53 configured to act as one-way valves; each nozzle 62, 63, 64, 65 is configured to act as a receiver at its proximal end and an ejector at its distal end; wherein, the first nozzle 62 is convergent-parallel-divergent, the second nozzle 63 is parallel, the third nozzle 64 is parallel-divergent and the fourth nozzle 65 is parallel-divergent; wherein, the distal end of the first nozzle 62 is connected to the vacuum chamber of the first stage 50 in its proximal portion; the proximal end of the second nozzle 63 is connected to the first stage 50 vacuum chamber in its distal portion; the distal end of the second nozzle 63 is connected to the second stage 51 vacuum chamber in its proximal portion; the proximal end of the third nozzle 64 is connected to the second stage 51 vacuum chamber in its distal portion; the distal end of the third nozzle 64 is connected to the third stage 52 vacuum chamber in its proximal portion; and the proximal end of the fourth nozzle 65 is connected to the third stage 52 vacuum chamber at its distal portion.

In other words, the proximal end of each nozzle 62, 63, 64, 65 is a receiver while the distal end is an ejector.

Nozzles 62, 63, 64, 65 are positioned internally to stages 50, 51, 52, configured longitudinally, and diaphragms 53 are positioned on the external surfaces of stages 50, 51, 52, orthogonally to nozzles 62, 63, 64, 65.

Each region formed between nozzles 62, 63, 64, 65 inside stages 50, 51, 52 is a vacuum chamber. Diaphragms 53 then are valves that control the air output in the vacuum chambers. The number of diaphragms 53 configured to act as one-way valves depends on the amount of air consumed by the multi-ejector vacuum generator.

Nozzles 62, 63, 64, 65, stages 50, 51, 52 and feed sleeve 54 are coaxial.

Diaphragms 53 are connected to each stage 50, 51, 52 so that between the surface of the stage and the diaphragm 53 there is a sealing ring, or o-ring 57.

A plate 60 is positioned so that the diaphragm 53 is between said plate 60 and the stage 50, 51, 52, in order to enable its operation as a valve, regulating the pressure between the interior of the multi-ejector vacuum generator and the external medium. Diaphragms 53 are configured to allow air to enter the stages when the outside pressure is greater than the inside pressure.

The plate 60 is fixed to the stage 50, 51, 52 by means of polymeric glue, screws, adhesives or polymeric or metallic weld.

A feed sleeve 54 is configured to connect the compressed air inlet with the first nozzle 62. Said feed sleeve 54 has a parallel shape with an internal diameter preferably between 10 and 110 mm, more preferably between 12 and 100 mm, and a length preferably between 20 and 250 mm, more preferably between 18 and 245 mm.

Feed sleeve 54 connects to first nozzle 62 by thread, snap rings, under pressure or interference.

The first nozzle 62 has, in its parallel portion, a constant throat diameter preferably between 3 and 60 mm, more preferably between 4 and 56 mm, even more preferably between 4.24 and 54.38 mm and, in its divergent portion, an angle of divergence preferably between 7 and 9 degrees, more preferably between 7.5 and 8.5 degrees, even more preferably between 7.9 and 8.3 degrees, and maximum diameter preferably between 5 and 95 mm, more preferably between 6 and 90 mm, even more preferably between 6.93 and 88.82 mm.

The second nozzle 63 has an internal diameter preferably between 10 and 160 mm, more preferably between 11 and 155 mm, even more preferably between 11.73 and 150.45 mm.

The third nozzle 64 has in its parallel portion, diameter preferably between 15 and 210 mm, even more preferably between 15.5 and 205 mm, even more preferably between 15.83 and 203.01 mm and in its divergent portion, maximum diameter preferably between 17 and 240 mm, more preferably between 18 and 236 mm, even more preferably between 18.32 and 234.91, and angle of divergence preferably between 0.5 and 3.5 degrees, more preferably between 1 and 3 degrees, furthermore more preferably between 1.5 and 2.5 degrees.

The fourth nozzle 65 has in its parallel portion, diameter preferably between 22 and 295 mm, more preferably between 22.5 and 293 mm, even more preferably between 22.81 and 292.54 mm and in its divergent portion, maximum diameter preferably between 25 and 330 mm, more preferably between 25.50 and 327.06 mm, and angle of divergence preferably between 1 and 5 degrees, even more preferably between 1.5 and 3 degrees.

The distance between the distal surface of the first nozzle 62 and the proximal surface of the second nozzle 63 is preferably between 2 and 40 mm, more preferably between 2.5 and 38.5 mm, even more preferably between 2.93 and 37.61 mm, the distance between the distal surface of the second nozzle 63 and the proximal surface of the third nozzle 64 is preferably between 2 and 55 mm, more preferably 3 and 53 mm, even more preferably between 3.96 and 50.75 mm and the distance between the distal surface of the third nozzle 64 and the proximal surface of the fourth nozzle 65 is preferably between 4 and 80 mm, more preferably between 5 and 75 mm, even more preferably between 5.70 and 73.14 mm.

Stages 50, 51, 52 and nozzles 62, 63, 64, 65 are connected by thread, snap rings, under pressure or interference.

Said stages 50, 51, 52 are made of metallic or polymeric material, preferably aluminum, 6351T6 or 7075. In a preferred configuration, they are all of the same material. In alternative configurations, they can be of different materials.

Said nozzles 62, 63, 64, 65 and the feed sleeve 54 are made of metallic or polymeric material, preferably aluminum, 6351T6 or 7075. In a preferred configuration, they are all of the same material. In alternative configurations, they can be of different materials.

The sizing of the components of said pump comprises the following steps:

a. definition of the intended free vacuum flow to atmosphere;
b. definition of the consumption of the vacuum generating pump 100;
c. calculating the diameter of the first nozzle 62 based on the consumption defined in the previous step;
d. definition of the expected vacuum level in the multi-ejector vacuum generator 2;
e. definition of a supersonic speed in the first nozzle 62;
f. calculation of the maximum diameter of the first nozzle 62 in order to provide the decrease in pressure without its total conversion into kinetic energy;
g. calculation of the receiver diameter based on the vacuum level defined in the first chamber;

h. calculation of the minimum distance between the first 62 and the second 63 nozzles;

i. calculation of the diameter of the second nozzle 63 based on the consumption defined in the previous steps;

j. definition of the expected vacuum level in the multi-ejector vacuum generator 2;

k. definition of a supersonic speed in the second nozzle 63;

l. calculation of the maximum diameter of the second nozzle 63 in order to provide the decrease in pressure without its total conversion into kinetic energy;

m. calculation of the receiver diameter based on the vacuum level defined in the second chamber;

n. calculation of the minimum distance between the second 63 and the third 64 nozzles;

o. calculation of the diameter of the third nozzle 64 based on the consumption defined in the previous step;

p. definition of the expected vacuum level in the multi-ejector vacuum generator 2;

q. definition of a supersonic speed on the third nozzle 64;

r. calculation of the maximum diameter of the third nozzle 64 in order to provide the decrease in pressure without its total conversion into kinetic energy;

s. calculation of the receiver diameter based on the vacuum level defined in the third chamber;

t. calculation of the minimum distance between the third 64 and fourth 65 nozzles;

u. calculation of the diameter of the fourth nozzle 65 based on the consumption defined in the previous step;

v. definition of the expected vacuum level in the multi-ejector vacuum generator 2;

w. definition of a supersonic speed in the fourth nozzle 65;

x. calculation of the maximum diameter of the fourth nozzle 65 in order to provide the decrease in pressure without its total conversion into kinetic energy;

y. calculation of the receiver diameter based on the vacuum level defined in the application.

Pump consumption is defined by the desired free vacuum flow. Air consumption is measured in Nl/min (Normal liters/minute), that is, it is a standardized measure, considering 20° C. (68° F.) and 1.01325 bar (14.69595 PSI). The present invention has a coefficient of 4.5 to 5.5 times the standard condition.

In other words, if we divide the intended free vacuum flow by this coefficient, we will find the consumption required to power the pump.

The present invention has fastening means for a multi-ejector vacuum generator 2 for a vacuum generator pump 100 comprising quick-release fastening system 7, 31, 6 having different openings 711, 311, 611 configured so that when the feeding pressure inlets, provided with quick-release fastening pins 21, go beyond the quick-release fastening system 7, 31, 6 and are rotated to the position defined in the second quick-release fastening system 31, the quick-release fastening system 31 does not allow its rotational movement, and the quick-release fastening system 7 does not allow its translational movement in the direction it entered. The first fastening system 7 has first openings 711, each of which has a first shape, the second fastening system 31 has second openings 311, each of which has a second shape, and the third fastening system 6 has third openings 611, each of which has a third shape. The first shape, the second shape, and the third shape are different from each other. In the fastening means: the first fastening system 7, the second fastening system 31, and the third fastening system 6 are arranged in order; a first center portion of a respective first opening 711 of the first fastening system 7, a second center portion of a respective second opening 311 of the second fastening system 31, and a third center portion of a respective third opening 611 of the third fastening system 6 are overlapped with each other; and the respective second opening 311 of the second fastening system 31 has first protruded portions 312, which are not overlapped with the first openings 711 of the first fastening system 7, and the respective third opening 611 of the third fastening system 6 has second protruded portions 612, which are not overlapped with the second openings 311 of the second fastening system 31.

The quick-release fastening system are arranged so that the quick-release fastening means has a first quick-release fastening system 7, a second quick-release fastening system 31 and a third quick-release fastening system 6. When inserted, the feeding pressure ports pass through the first quick-release fastening system 7, then the second quick-release fastening system 31 and then the third quick quick-release fastening 6.

In other words, the multi-ejector vacuum generator 2 is inserted into the fastening means made up of the system 7, 31, 6. The position of the multi-ejector vacuum generator 2 is guided by the quick-release fastening pins 21 together with the opening of the quick-release fastening system 7. In the same position defined by the quick-release fastening system 7, it is inserted into the quick-release fastening system 31 and 6. When fully inserted, the multi-ejector vacuum generator 2 is rotated, so that the pins the quick-release fastening pins 21 are locked by opening the quick-release fastening system 6. After the rotation limitation caused by the contact of the quick-release fastening pins 21 with the opening of the quick-release fastening system 6, the multi-ejector vacuum generator 2 is then returned into a position where the quick-release fastening pins 21 are limited by the opening in the quick-release fastening system 31.

In this way, the quick-release fastening pins 21 and consequently the multi-ejector vacuum generator 2 are locked axially by the quick-release fastening system 7 and radially by the quick-release fastening system opening 31.

The present invention also discloses a vacuum generator pump 100 comprising at least a suppressor 1, a vacuum pump body 10, a lower closing cap 37, multi-ejector vacuum generator 2 fastening means, O-ring vacuum pump body closing 22, compressed air passage plate 38, function plate for compressed air 20, air passage control solenoid valves 13, finishing cap for solenoid valves 9, top closing lid 5, pressure gauge 33, vacuum gauge 42, compressed air inlet flange 17.

Suppressor 1 is coaxial with multi-ejector vacuum generator 2 and consequently coaxial with nozzles 62, 63, 64, 65, stages 50, 51, 52 and feed sleeve 54.

The vacuum pump body 10 comprises an internal support for fastening the vacuum inlet flange 16, vacuum inlet flange 18, reinforcement ring for the mesh 19, steel mesh at the vacuum inlet 40 and O-ring 43. Said flanges and steel mesh allow a brief air filtration so that the air exchange can be carried out according to the configuration of the diaphragms 53 that act as valves.

In a preferred embodiment, the multi-ejector vacuum generators 2 are positioned internally to the vacuum pump body 10. In this embodiment, the multi-ejector vacuum generators 2 are fixed by fastening means at its upper end and, at its upper end bottom, by the lower closing lid 37 together with ejector fastening nuts 34.

In an alternative embodiment, the multi-ejector vacuum generator 2 is external to the vacuum pump body 10'.

At its lower end, the multi-ejector vacuum generator 2 is connected to the suppressors 1. At its upper end, the multi-ejector vacuum generator 2 is connected with the vacuum pump body closing o-ring 22, compressed air passage plate 38, function plate for compressed air 20, air passage control solenoid valves 13, finishing cap for the solenoid valves 9, as well as pressure gauge 33 and vacuum gauge 42, in addition to the compressed air inlet flange 17.

The compressed air, after passing through the compressed air inlet flange 17, passes through the pressure gauge 33 and vacuum gauge 42 in the manifold 67, and then is submitted to the air passage control solenoid valves 13. In an alternative embodiment, only the manifold 67 is present in the pump. In another embodiment, only air passage control solenoid valves 13 are present.

The manifold 67 works as a pre-chamber, which receives the compressed air and normalizes its pressure, in addition to distributing the air to each multi-ejector vacuum generator 2.

The pressure in the pre-chamber is preferably between 4 and 7 bar, more preferably between 5 and 6 bar, even more preferably 5.5 bar.

The air passage control solenoid valves 13 make it possible to activate or deactivate the pump, just like an on/off switch. In an alternative embodiment, the air passage control solenoid valves 13 allow the regulation of the compressed air flow, defining a greater or lesser vacuum.

After passing through the air passage control solenoid valves 13, the compressed air passes through the compressed air passage plate 38 and the function plate for compressed air 20, in order to be distributed to each of the multi-ejector vacuum generators 2.

Each vacuum generating pump 100 can comprise one or more multi-ejector vacuum generators 2, connected in series or parallel, depending on the required vacuum.

By disclosing the multi-ejector vacuum generator as detailed in this invention, comprising multi-ejectors and stages as defined above, the present invention fulfills the proposed objective, namely a vacuum generator pump 100 with considerably higher efficiency than the vacuum pumps on the market, in particular, to multi-ejector vacuum pumps.

Table 1 shows different embodiments of multi-ejectors from different brands, for a vacuum level of −90 kPa. It should be noted that, for the same vacuum level, some pumps need 1320 to 1680 Nl/min, while the present invention (called Franco) is capable of achieving the same vacuum level and equal or greater vacuum flow with only 876 Nl/min.

TABLE 1

Comparison of multi-ejectors from different brands

| Brand | Number of multi-ejector vacuum generators | Code | Vacuum (-kPa) | Consumption (Nl/min) | Efficiency (%) |
|---|---|---|---|---|---|
| Piab | 11 | Pi6040-Pi48-3X11 @3.1 bar | −90 | 1320 | 15 |
| Piab | 12 | Pi6040-Pi48-3X12 @3.1 bar | −90 | 1440 | 15 |
| Piab | 13 | Pi6040-Pi48-3X13 @3.1 bar | −90 | 1560 | 15 |
| Piab | 14 | Pi6040-Pi48-3X14 @3.1 bar | −90 | 1680 | 15 |

TABLE 1-continued

Comparison of multi-ejectors from different brands

| Brand | Number of multi-ejector vacuum generators | Code | Vacuum (-kPa) | Consumption (Nl/min) | Efficiency (%) |
|---|---|---|---|---|---|
| Franco | 1 | Master Q s, I mm @5.5bar | −92.9 | 876 | 29.7 |

Table 2 reveals other multi-ejector configurations, for a vacuum level of −90 kPa. Note that, for the same vacuum level, some pumps need 1680 to 1920 Nl/min, while the present invention is capable of achieving the same vacuum level, or even more vacuum with the same vacuum flow or higher, with only 944 Nl/min.

TABLE 2

Comparison of multi-ejectors for the same vacuum level

| Brand | Number of multi-ejector vacuum generators | Code | Vacuum (-kPa) | Consumption (Nl/min) | Efficiency (%) |
|---|---|---|---|---|---|
| Piab | 16 | Maxi-MLL400 | 91 | 1680 | 18 |
| Piab | 16 | Pi6040-Pi48-3X16 @3.1bar | 90 | 1920 | 15 |
| Franco | 3 | Hib (2x) n, 8 and (1x) s, 1 RGS @6.0 bar | 96.4 | 944 | 34.6 |

Table 3 reveals a comparison between different models from different brands based on their efficiency. Efficiency was obtained by integrating the consumption curves by vacuum level.

TABLE 3

Comparison of multi-ejectors by efficiency

| Brand | Model | Efficiency (%) |
|---|---|---|
| Piab | Pi | 15 |
| Piab | Xi | 18 |
| Piab | Si | 22 |
| Max MLL | 400 | 18 |
| Round | Si | 23 |
| Franco | Master | 29.7 |
| Franco | Hib | 34.6 |

Figure 8:
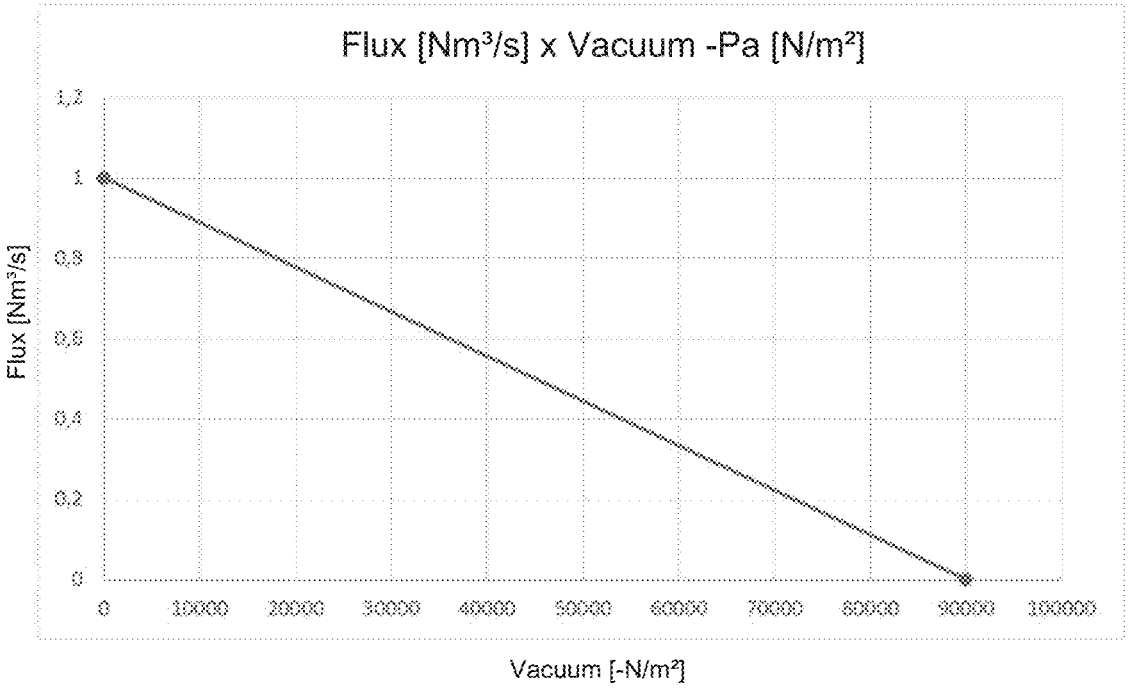
FIG. 8 shows a graph of the vacuum generated as a function of the normalized air flow consumed.
Figure 9:
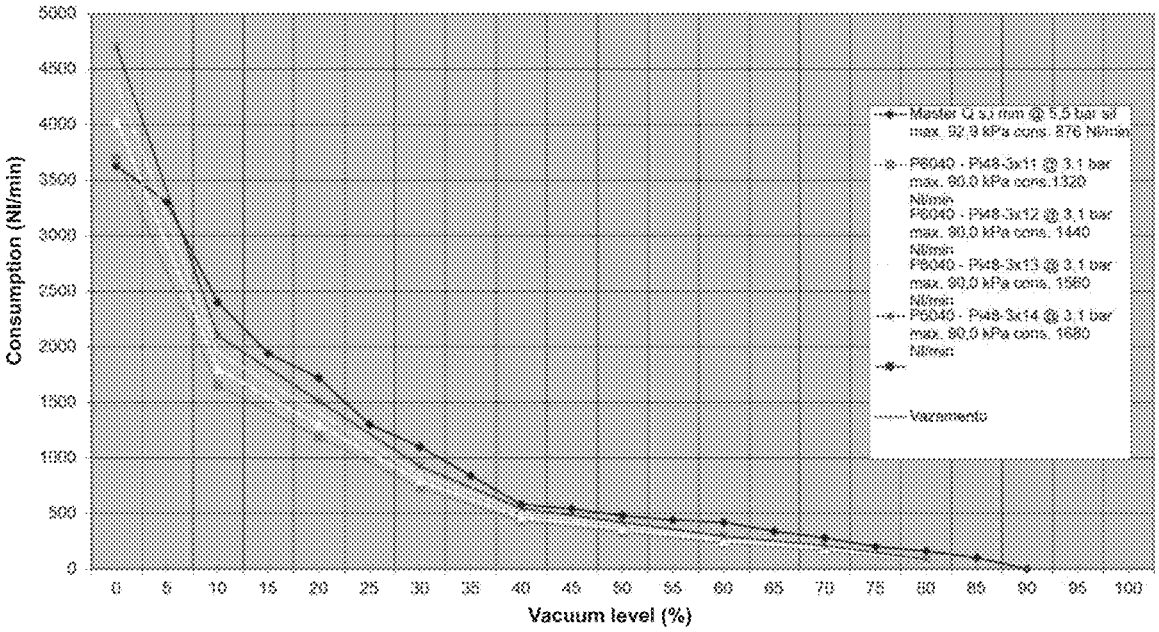
FIGS. 9 and 10 show experimental graphs of consumption by vacuum level of different multi-ejector vacuum generators.
Figure 10:
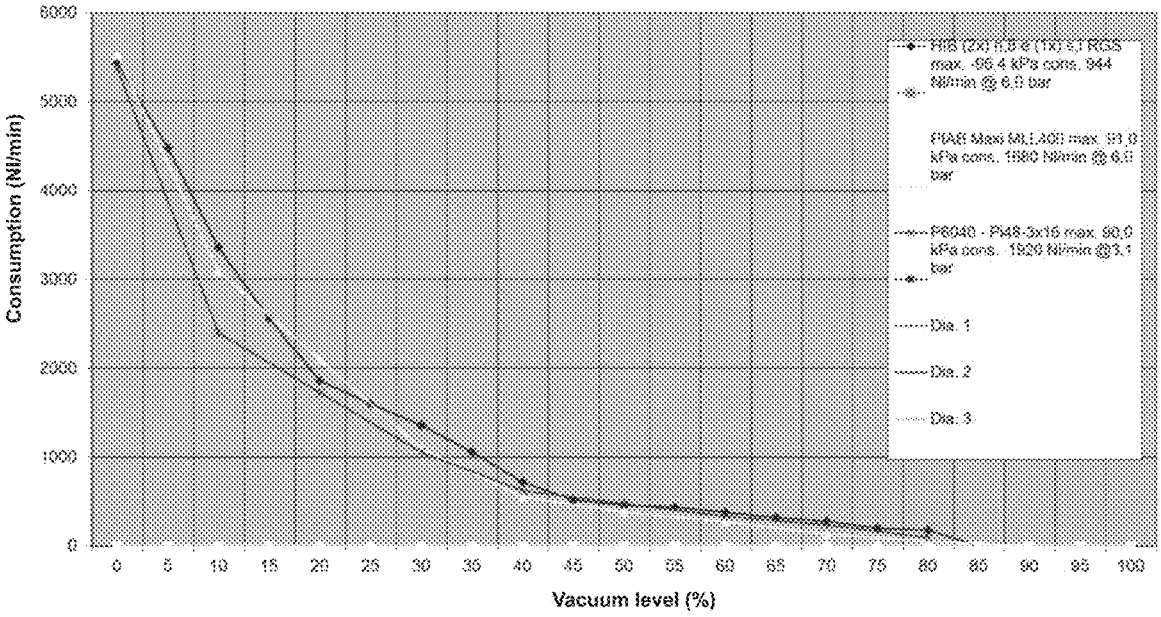

Note that, for efficiency calculations, the integral of the generated vacuum (kPa ($N/m^2$)) is calculated as a function of air flow ($Nm^3/s$), as shown in FIG. 8. Equation 1, below, demonstrates how the integral or area under the curve reveals the resulting power at the pump:

$$\text{Area} = \int_a^b f(x)dx = \frac{b \cdot k}{2} = \frac{\frac{N}{m^2} \cdot \frac{m^2}{s}}{2} = \frac{N \cdot m}{2\ s} = \frac{F \cdot d}{t} = \text{watt} \tag{1}$$

The generated vacuum curve (kPa ($N/m^2$)) as a function of air flow ($Nm^3/s$) is not linear, and FIG. 8 and equation 1 are only an illustrative model. For calculating the power of airflow vacuum pumps, a normalized consumption of 128 Nl/min (normal liters per minute) is equivalent to 1 hp or 745.7 Watts.

For comparison purposes, good multi-ejector vacuum pumps available on the market are efficient in the order of 15%, while good mechanical vacuum pumps are just under 40% efficient, and vacuum pumps with radial compressors are less than 35% efficient, of efficiency.

It should be noted that the drawings presented are not necessarily to scale, having a purely conceptual nature. Nevertheless, it is expressly provided that all combinations of elements that perform the same function in substantially the same way to achieve the same results as the elements claimed herein, are within the scope of the present invention. Finally, it should be noted that the scope of protection of the present invention covers other possible variations, not being limited solely by the content of the claims only, including possible equivalents.

The invention claimed is:

1. A vacuum generator pump (100) including a multi-ejector vacuum generator (2) and a fastening means, wherein the multi-ejector vacuum generator (2) comprises at least three stages (50, 51 and 52), and at least four nozzles (62, 63, 64, 65), wherein:

each stage (50, 51 and 52) comprises a vacuum chamber and at least two diaphragms (53) configured to act as valves; and each nozzle (62, 63, 64, 65) is configured to act as a receiver at its proximal end and an ejector at its distal end, wherein, the distal end of the first nozzle (62) is connected to the first stage (50) vacuum chamber in its proximal portion; the proximal end of the second nozzle (63) is connected to the first stage (50) vacuum chamber in its distal portion; the distal end of the second nozzle (63) is connected to the second stage (51) vacuum chamber in its proximal portion; the proximal end of the third nozzle (64) is connected to the second stage (51) vacuum chamber in its distal portion; the distal end of the third nozzle (64) is connected to the third stage (52) vacuum chamber in its proximal portion; and the proximal end of the fourth nozzle (65) is connected to the third stage (52) vacuum chamber in its distal portion, wherein the fastening means comprises fastening systems (7, 31, 6) having different openings (711, 311, 611) configured so that when fastening pins (21) of the multi-ejector vacuum generator (2) are inserted into the fastening systems (7, 31, 6) and are rotated to a defined position on the second fastening system (31), the second fastening system (31) does not allow rotational movement of the fastening pins (21), and the first fastening system (7) does not allow translational movement of the fastening pins (21), in the direction in which the fastening pins (21) entered, wherein the first fastening system (7) has first openings (711), each of which has a first shape, the second fastening system (31) has second openings (311), each of which has a second shape, and the third fastening system (6) has third openings (611), each of which has a third shape, wherein the first shape, the second shape, and the third shape are different from each other, and wherein, in the fastening means:

the first fastening system (7), the second fastening system (31), and the third fastening system (6) are arranged in order;

a first center portion of a respective first opening (711) of the first fastening system (7), a second center portion of a respective second opening (311) of the second fastening system (31), and a third center portion of a respective third opening (611) of the third fastening system (6) are overlapped with each other; and the respective second opening (311) of the second fastening system (31) has first protruded portions (312), which are not overlapped with the first openings (711) of the first fastening system (7), and the respective third opening (611) of the third fastening system (6) has second protruded portions (612), which are not overlapped with the second openings (311) of the second fastening system (31).

2. The vacuum generator pump (100) according to claim 1, wherein the nozzles (62, 63, 64, 65) are positioned internally to the stages (50, 51 and 52), configured longitudinally, and the diaphragms (53) are positioned on the external surfaces of the vacuum chamber of the stages (50, 51 and 52), orthogonally to the nozzles (62, 63, 64, 65).

3. The vacuum generator pump (100) according to claim 1, further comprising: a feeding sleeve (54) configured to connect a suppressor (1) with the first nozzle (62).

4. The vacuum generator pump (100) according to claim 3, further comprising: a manifold reservoir (67) or air passage control solenoid valves (13), which is placed between the compressed air inlet and the first nozzle (62).

5. The vacuum generator pump (100) according to claim 1, wherein the first nozzle (62) has, in its parallel portion, a diameter between 3 and 60 mm, and, in its diverging portion, angle of divergence between 7 and 9 degrees, and a maximum diameter between 5 and 95 mm.

6. The vacuum generator pump (100) according to claim 1, wherein the second nozzle (63) has an internal diameter between 10 and 160 mm.

7. The vacuum generator pump (100) according to claim 1, wherein the third nozzle (64) has, in its parallel portion, a diameter between 15 and 210 mm, and in its divergent portion, maximum diameter between 17 and 240 mm, and angle of divergence between 0.5 and 3.5 degrees.

8. The vacuum generator pump (100) according to claim 1, wherein the fourth nozzle (65) has, in its parallel portion, a diameter between 22 and 295 mm, and in its divergent portion, maximum diameter between 25 and 330 mm, angle of divergence between 1 and 5 degrees.

9. The vacuum generator pump (100) according to claim 1, wherein the distance between the distal surface of the first nozzle (62) and the proximal surface of the second nozzle (63) is between 2 and 40 mm, the distance between the distal surface of the second nozzle (63) and the proximal surface of the third nozzle (64) is between 2 and 55 mm, and the distance between the distal surface of the third nozzle (64) and the proximal surface of the fourth nozzle (65) is between 4 and 80 mm.

10. The vacuum generator pump (100) according to claim 1, wherein the multi-ejector vacuum generator (2) is configured by the following steps:

determining an intended free vacuum flow to atmosphere;

determining a capacity of the vacuum generator pump (100);

calculating a diameter of the first nozzle (62) based on the determined capacity;

determining an expected vacuum level in the multi-ejector vacuum generator (2);

determining a supersonic speed in the first nozzle (62);

calculating a diameter of the first nozzle (62), based on a vacuum level defined in a first chamber;

calculating a minimum distance between the first nozzle (62) and the second nozzle (63);

determining a supersonic speed in the second nozzle (63);

calculating a receiver diameter of the second nozzle (63), based on a vacuum level defined in a second chamber;

calculating a minimum distance between the second nozzle (63) and third nozzle (64);

determining a supersonic speed in the third nozzle (64);

calculating a receiver diameter of the third nozzle (64), based on the vacuum level defined in the third chamber;

calculating a minimum distance between the third nozzle (64) and fourth nozzle (65);

determining a supersonic speed in the fourth nozzle (65);

calculating a receiver diameter of the fourth nozzle (65), based on a vacuum level of the multi-ejector vacuum generator (2).

* * * * *